US008690614B2

(12) United States Patent
Eshima

(10) Patent No.: US 8,690,614 B2
(45) Date of Patent: Apr. 8, 2014

(54) CABLE FIXING METHOD AND CABLE CONNECTING PART

(75) Inventor: Hirotaka Eshima, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 507 days.

(21) Appl. No.: 12/659,992

(22) Filed: Mar. 26, 2010

(65) Prior Publication Data

US 2010/0248540 A1 Sep. 30, 2010

(30) Foreign Application Priority Data

Mar. 27, 2009 (JP) ..... 2009-080085
Dec. 11, 2009 (JP) ..... 2009-281316
Feb. 5, 2010 (JP) ..... 2010-024255

(51) Int. Cl.
*H01R 4/10* (2006.01)

(52) U.S. Cl.
USPC ..... 439/882

(58) Field of Classification Search
USPC ..... 439/607.01, 877–879, 882
See application file for complete search history.

(56) References Cited

U.S. PATENT DOCUMENTS 3,065,292 A * 11/1962 Chickvary ..... 174/84 C
4,966,560 A * 10/1990 Marzouk ..... 439/585
5,154,637 A * 10/1992 Klug et al. ..... 439/585
6,305,985 B1 * 10/2001 Akiha ..... 439/607.02
6,808,416 B2 * 10/2004 Fegley et al. ..... 439/585
2004/0018771 A1 1/2004 Togashi

FOREIGN PATENT DOCUMENTS

JP 5-6784 1/1993
JP 2004-55475 A 2/2004
JP 2006-278207 A 10/2006
JP 2006-324034 11/2006
JP 2006-324034 A 11/2006

OTHER PUBLICATIONS

Japanese Office Action dated Apr. 23, 2013 with English translation thereof.

* cited by examiner

*Primary Examiner* — Neil Abrams
*Assistant Examiner* — Travis Chambers
(74) *Attorney, Agent, or Firm* — McGinn IP Law Group, PLLC

(57) ABSTRACT

A cable fixing method and a cable connecting part for a connector. In the cable fixing method and the cable connecting part, a part of a cable in a longitudinal direction is inserted into a metallic cylindrical part of a metallic case; and the cable is fixed to the metallic case by crimping the metallic cylindrical part which accommodates the part of the cable in the longitudinal direction in such a manner that $0.60 \leq K \leq 0.95$ is established, when a cross-sectional area of the cable before crimping the metallic cylindrical part is A, a cross-sectional area of the cable after crimping the metallic cylindrical part is B, and B/A is a crimping ratio K.

20 Claims, 12 Drawing Sheets

CABLE FIXING METHOD AND CABLE CONNECTING PART

The present application is based on Japanese patent application No. 2009-80085 filed on Mar. 27, 2009, Japanese patent application No. 2009-281316 filed on Dec. 11, 2009, and Japanese patent application No. 2010-024255 filed on Feb. 5, 2010, the entire contents of which are incorporated herein by reference.

BACKGROUND OF THE INVENTION

1. Field of the Invention

The present invention relates to a cable fixing method and a cable connecting part, more particularly, to a cable fixing method and a cable connecting part for a cable to be used in swinging parts or the like in vehicles, robots and the like.

2. The Related Art

In vehicles such as automobile, various electronic equipments and electromotive equipments are used. Control signal, electric power or the like is transmitted to these electronic equipments or the electromotive equipments via an electric wire installed in the vehicle. A connector suitable for connecting this electric wire to the electronic equipments or the electromotive equipments has been demanded.

By way of example only, Japanese Patent Laid-Open No. 5-6784 (JP-A 5-6784) discloses an example of conventional connectors. Japanese Patent Laid-Open No. 2006-324034 (JP-A 2006-324034) discloses another example of the conventional connectors.

When the electric wire is installed in the vehicles such as automobile, water proofing property is required for a connecting part which connects the electric wire and the equipments, in an operating environment outside a compartment of vehicle. Further, since mud or snow may be bonded to the electric wire in the environment outside the compartment of vehicle, a large tensile force may be applied to the connecting part (connector) for connecting between the electric wire and the equipment from the electric wire due to oscillation.

The tensile force is about 98N according to a technical standard for a conventional connector, and a safety against the tensile force more than 98N is not ensured. Therefore, for suppressing the tensile force to be applied to the connector, it is necessary for several places to fix the electric wire with short pitches to a car body or a component fixed in vicinity of the car body. As a result, there is a problem in that an operation becomes troublesome in assembling and maintenance of the vehicle.

Therefore, the connector is required to have enough holding force (grasping force) for holding the electric wire against the tensile force to be applied to the connector. Even more particularly, an impact due to bounced pebbles or the like may be applied to the connecting part in the environment outside the compartment of vehicle. Therefore, the connector is required to have such a mechanical strength that the connector would not be damaged by the impact applied to the connector.

In general, the connector for a terminal structure of the electric wire used for the automobile is made of resin such as nylon or PBT (polybutylene terephthalate). However, there is a disadvantage in that the connector made of the resin hardly satisfies all the requests such as water proofing property, holding force of the electric wire against the tensile force, and mechanical strength.

SUMMARY OF THE INVENTION

Accordingly, it is an object of the present invention to provide a cable fixing method and a cable connecting part, by which the above problems can be solved by a simple structure, and which can be used in an environment outside the compartment of vehicle.

Further, it is another object of the present invention to provide a cable fixing method and a cable connecting part, which has sufficient water proofing property, holding force of the electric wire against the tensile force, and mechanical strength.

According to a feature of the invention, a cable fixing method comprises:

inserting a part of a cable in a longitudinal direction into a metallic cylindrical part of a metallic case; and fixing the cable to the metallic case by crimping the metallic cylindrical part which accommodates the part of the cable in the longitudinal direction in such a manner that $0.60 \leq K \leq 0.95$ is established, in which a cross-sectional area of the cable before crimping the metallic cylindrical part is A, a cross-sectional area of the cable after crimping the metallic cylindrical part is B, and B/A is a crimping ratio K.

In the method, the metallic case may further comprise a terminal holder accommodating part, a terminal press-fitted to a core of the cable is fixed to a terminal holder comprising an insulative material, and the terminal holder is accommodated in and fixed to the terminal holder accommodating part to provide a connector.

The metallic cylindrical part may be crimped to form a plurality of recesses at an outer periphery of a crimping region which is a part of the metallic cylindrical part, and $C \geq D/5$ is established in which C is a total area of the plurality of recesses formed after crimping the metallic cylindrical part and D is a surface area of the crimping region before crimping the metallic cylindrical part.

The metallic cylindrical part may be crimped to form a plurality of recesses at an outer periphery of a crimping region which is a part of the metallic cylindrical part, and $C \geq D/5$ is established wherein C is a total area of the plurality of recesses formed after crimping the metallic cylindrical part and D is a surface area of the crimping region before crimping the metallic cylindrical part.

The cable may comprise a core comprising a single wire or a stranded wire made of a plurality of wire conductors, an insulative coating layer provided at an outer periphery of the core, a sheath layer provided as an outermost layer, and a reinforcing braided layer provided between the insulative coating layer and the sheath layer, the reinforcing braided layer comprising braided fiber materials made of polymer.

The connector may further comprise a resin cover or rubber cover at an outer surface of the metallic case.

According to another feature of the invention, a cable connecting part comprises:

a metallic case comprising a metallic cylindrical part which accommodates a part of a cable in a longitudinal direction, in which the metallic cylindrical part accommodating the part of the cable in the longitudinal direction is crimped to fix the cable to the metallic case, in such a manner that $0.60 \leq K \leq 0.95$ is established, in which a cross-sectional area of the cable before crimping the metallic cylindrical part is A, a cross-sectional area of the cable after crimping the metallic cylindrical part is B, and B/A is a crimping ratio K.

In the cable connecting part, the metallic case may further comprise a terminal holder accommodating part, a terminal press-fitted to a core of the cable is fixed to a terminal holder comprising an insulative material, and the terminal holder is accommodated in and fixed to the terminal holder accommodating part to provide a connector.

The metallic cylindrical part may be crimped to form a plurality of recesses at an outer periphery of a crimping region which is a part of the metallic cylindrical part, and C≥D/5 is established in which C is a total area of the plurality of recesses formed after crimping the metallic cylindrical part and D is a surface area of the crimping region before crimping the metallic cylindrical part.

The metallic cylindrical part may be crimped to form a plurality of recesses at an outer periphery of a crimping region which is a part of the metallic cylindrical part, and C≥D/5 is established wherein C is a total area of the plurality of recesses formed after crimping the metallic cylindrical part and D is a surface area of the crimping region before crimping the metallic cylindrical part.

The cable may comprise a core comprising a single wire or a stranded wire made of a plurality of wire conductors, an insulative coating layer provided at an outer periphery of the core, a sheath layer provided as an outermost layer, and a reinforcing braided layer provided between the insulative coating layer and the sheath layer, the reinforcing braided layer comprising braided fiber materials made of polymer.

The connector may further comprise a resin cover or rubber cover at an outer surface of the metallic case.

Advantages of the Invention

According to the present invention, an electric wire or cable is secured to a metallic case by crimping a metallic cylindrical part in such a manner that 0.60≤K≤0.95 is established, wherein a cross-sectional area of the electric wire or cable before crimping the metallic cylindrical part is A, a cross-sectional area of the electric wire or cable after crimping the metallic cylindrical part is B, and B/A is a crimping ratio K. According to this structure, the metallic cylindrical part cuts (bites) into a coating of the electric wire or cable adequately at a crimping point. Since the coating of the electric wire closely contacts with the metallic cylindrical part of the metallic case, there are advantages in that the water proofing property is ensured and the holding force of the electric wire against the tensile force is increased. Furthermore, since the metallic case is used as a case for accommodating a terminal of the electric wire, the connecting part has high mechanical strength against impact from outside, such as bounced pebbles. Therefore, it is possible to connect the electric wire with the electronic equipments and electromotive devices, even in the environment outside the compartment of vehicle, in which the impact due to the bounced pebbles or the water immersion may occur.

The terminal, to which the core of the electric wire is press-fitted (crimped), is secured to a terminal holder accommodating part of the metallic case, via the insulative terminal holder. Therefore, it is possible to accommodate the terminal in the metallic case without short-circuiting the terminals to each other.

Still further, although the cable connecting part of present invention has a simple structure, it can be used even in the environment outside the compartment of vehicle. Furthermore, it is possible to provide the cable connecting part with sufficient water proofing property, holding force of the electric against the tensile force, and mechanical strength. In addition, since the cable connecting part has a little number of the components and a simple structure, it is possible to reduce the fabrication cost.

BRIEF DESCRIPTION OF THE DRAWINGS

The embodiments according to the invention will be explained below referring to the drawings, wherein:

FIGS. 3A to 3D are explanatory diagrams showing a method for fixing a terminal in a terminal holder of the connector in the first preferred embodiment according to the present invention, wherein FIG. 3A shows a state where the terminal is inserted into the terminal holder, FIG. 3B shows a state where the terminal is secured to the terminal holder, FIG. 3C shows a bottom surface of the terminal holder, and FIG. 3D shows a bottom surface of the terminal;

FIGS. 4A and 4B are diagrams showing the cable to be secured, wherein FIG. 4A is a perspective view showing a structure of the cable, and FIG. 4B is a cross sectional view of the cable;

FIGS. 7A to 7D are diagrams showing electric wire and cable to be used for the connector, wherein FIG. 7A is a cross sectional view of an electric wire having two power lines or signal lines, FIG. 7B is a side view thereof, FIG. 7C is a cross sectional view of a complex type cable having two power lines and two signal lines, FIG. 7D is a side view thereof.

FIGS. 11A and 11B are diagrams showing a metallic case used for the fixing structure in the third embodiment according to the present invention, wherein FIG. 11A is a front view thereof, and FIG. 11B is a side view thereof.

DETAILED DESCRIPTION OF THE EMBODIMENTS

Next, a connector in the embodiments according to the present invention will be explained below in more detail in conjunction with the appended drawings.

First Embodiment

Figure 1:
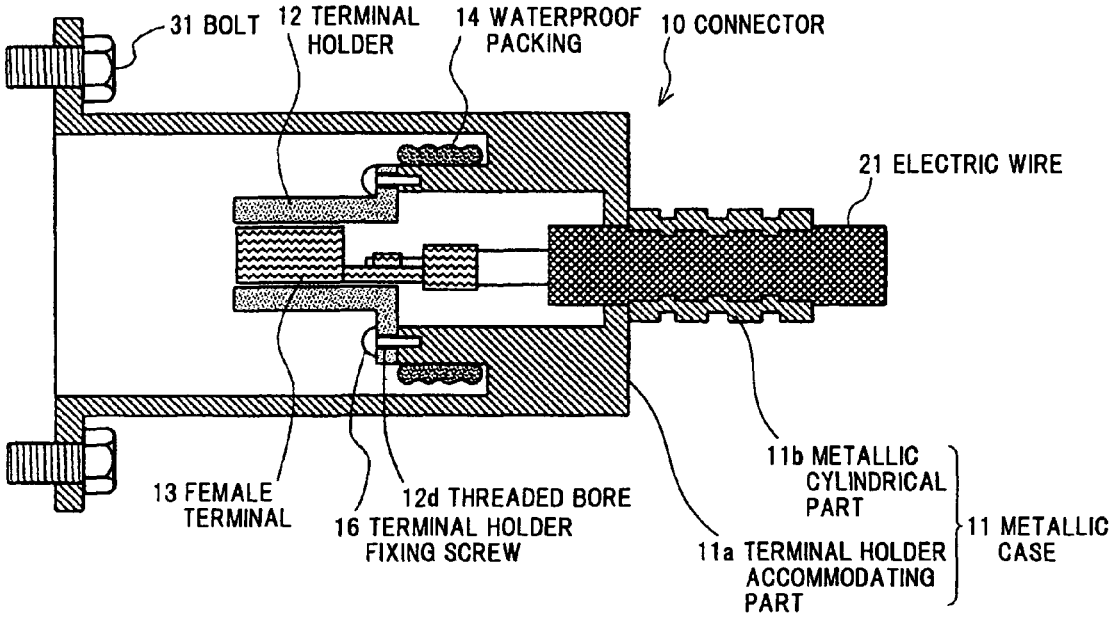
FIG. 1 is a longitudinal cross sectional view of a connector in the first embodiment according to the present invention.
Figure 2:
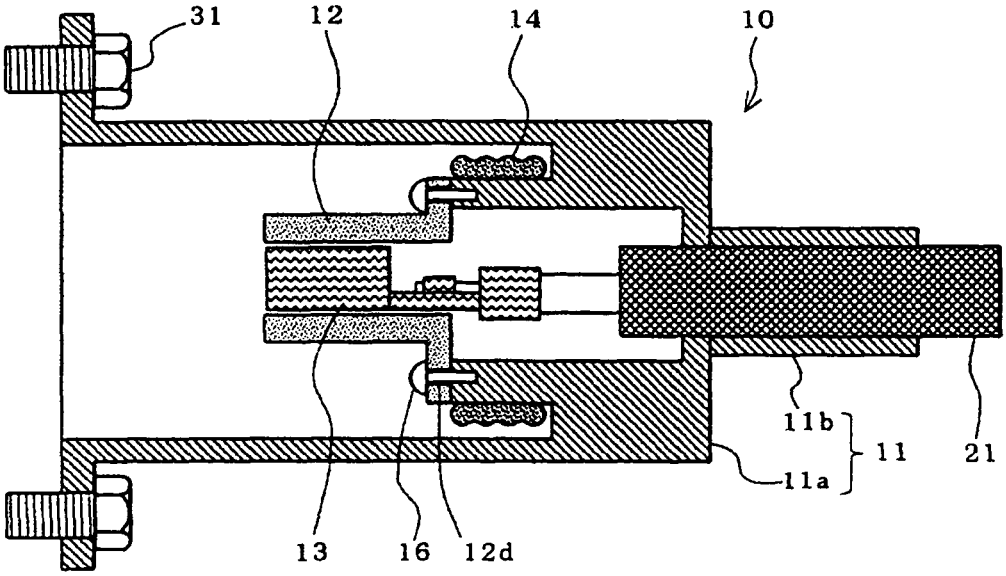
FIG. 2 is a longitudinal cross sectional view of the connector shown in FIG. 1 before crimping.

FIG. 1 is a longitudinal cross sectional view of a connector (female connector) 10 in the first embodiment according to the present invention. FIG. 2 is a longitudinal cross sectional view of the connector 10 shown in FIG. 1 before crimping.

(Total Structure of the Connector 10)

Referring to FIG. 1, the connector 10 comprises a metallic case 11 comprising a terminal holder accommodating part 11*a* which is made of metal and a metallic cylindrical part 11*b*. In the connector 10, an electric wire 21 is inserted into the metallic case 11 comprising the terminal holder accommodating part 11*a* and the metallic cylindrical part 11*b*, and a female terminal 13 press-fitted (crimped) to a wire of the electric wire 21 is fixed to a terminal holder 12 comprising an insulative material such as PBT or nylon. Thereafter, the terminal holder 12 is accommodated in the terminal holder accommodating part 11*a*, as shown in FIG. 2, and the electric wire 21 is fixed to the metallic case 11 by crimping the metallic cylindrical part 11*b* accommodating the electric wire 21. The metallic cylindrical part 11*b* of the metallic case 11 is formed integrally with the terminal holder accommodating part 11*a* by integral molding or formed by brazing to the terminal holder accommodating part 11*a*. The crimping is carried out, for example, by compressing the metallic cylindrical part 11*b* inwardly in a circumferential direction (i.e. from outside to inside in the circumferential direction) with a chisel-shaped tab to carry out spot-crushing (i.e. crushing locally at several spots) on the metallic cylindrical part 11*b* from an outer periphery thereof. A waterproof packing 14 is provided annularly around the terminal holder 12. According to this structure, water tightness of a connecting part can be kept, when the connector 10 is connected to a male connector (not shown). In addition, the metallic case 11 is provided with a bolt 31 for threadably mounting the metallic case 11 on an exterior equipment side (e.g. a case of the exterior equipment), so as to prevent the connector 10 from being detached from the exterior equipment to which the connector 10 is connected.

(Mechanism for Fixing the Female Terminal 13)

Figure 3A:
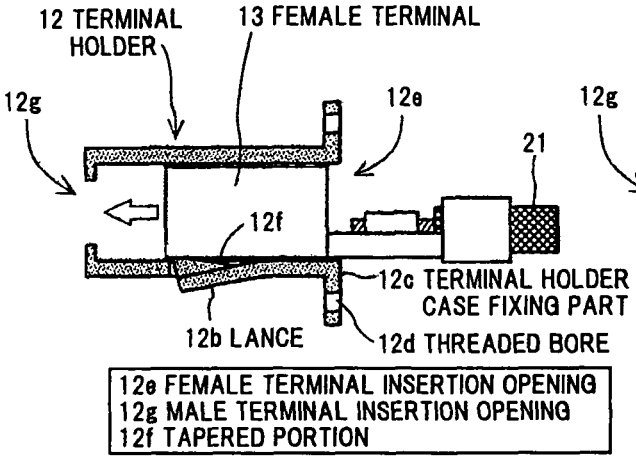
Figure 3B:
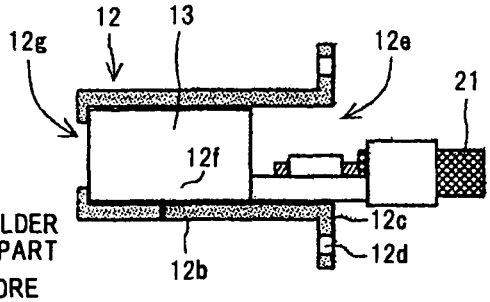
Figure 3C:
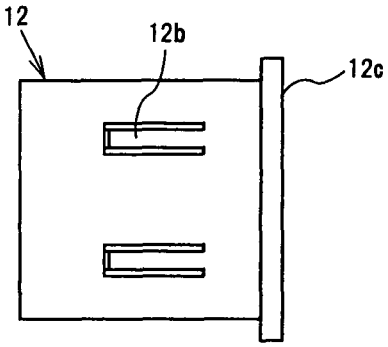
Figure 3D:
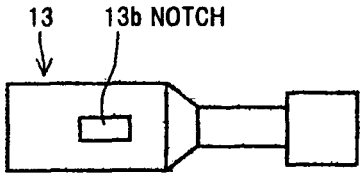

FIGS. 3A to 3D are explanatory diagrams showing a method for fixing the female terminal 13 in a terminal holder 12 of the connector 10 in the first preferred embodiment according to the present invention, wherein FIG. 3A shows a state where the female terminal 13 is inserted into the terminal holder 12, FIG. 3B shows a state where the female terminal 13 is secured to the terminal holder 12, FIG. 3C shows a bottom surface of the terminal holder 12, and FIG. 3D shows a bottom surface of the female terminal 13.

Referring to FIGS. 3A to 3C, the terminal holder 12 is provided with a small locking tab (lance) 12*b*, which is separated from a main body of the terminal holder 12 at three sides. the lance 12*b* is formed to protrude upwardly from the main body of the terminal holder 12. The lance 12*b* is provided with a tapered portion 12*f*. The terminal holder 12 further comprises a terminal holder case fixing part 12*c*, through which a main body of the terminal holder 12 is fixed to the metallic case 11, a threaded bore 12*d* into which the terminal holder fixing screw 16 (shown in FIG. 1) will be inserted, a female terminal insertion opening 12*e* through which the female terminal 13 is inserted, and a male terminal insertion opening 12*g* through which a male terminal (not shown) is inserted.

The female terminal 13 is provided with a notch 13*b*, into which the lance 12*b* fits at an appropriate position. Since the terminal holder 12 is made of resin, when the female terminal 13 is inserted into the terminal holder 12, the lance 12*b* is pushed down by the female terminal 13, then the lance 12*b* moves downwardly (toward an outer side of the terminal holder 12). Therefore, the female terminal 13 is inserted deeply into the terminal holder 12 without abutting the lance 12*b* and stopping in mid-course. When the terminal 13 is inserted until a predetermined position in the terminal holder 12, the lance 12*b* moves upwardly and fits into the notch 13*b* to be fixed. The lance 12*b* is formed to provide the tapered portion (a slope portion) 12*f* at one end of the lance 12*b* on the side of the female terminal insertion opening 12*e*, and a vertical cut-off plane at another end of the lance 12*b* on the side of the male terminal insertion opening 12*g*. In other words, an upper surface (at an inner side of the terminal holder 12) of the lance 12*b* is inclined toward the female terminal insertion opening 12*e*, and a side surface of the lance 12*b* in vicinity of the male terminal insertion opening 12*g* is vertical to a lower surface (at the outer side of the terminal holder 12) of the lance 12*b*. Therefore, after the lance 12*b* fits into the notch 13*b* of the terminal 13, an edge of the notch 13*b* abuts against the vertical cut-off plane of the lance 12*b*, so that the female terminal 13 will not be detached from the terminal holder 12 even when the female terminal 13 is pulled. Further, the terminal holder 12 is provided with the terminal holder case fixing part 12*c* at one end to be attached to the metallic case 11. The terminal holder case fixing part 12*c* is threadably mounted on the metallic case 11. By way of example only, the threaded bore 12*d* is provided at the terminal holder case fixing part 12*c*, and the terminal holder case fixing part 12*c* is secured to the terminal holder accommodating part 11*a* of the metallic case 11 by a terminal holder fixing screw 16, as shown in FIGS. 1 and 2.

(Relationship Between the Crimping Ratio and the Cable Holding Force)

The Inventor contemplated that the cable holding force of the connector 10 may be greatly varied in accordance with a level of compressive crimping of the metallic cylindrical part 11*b*.

Therefore, as to the compressing crimping of the metallic cylindrical part 11*b*, a test for evaluating the relationship between a crimping ratio and the cable holding force was carried out. Herein, a crimping ratio K is determined as follows. A cross-sectional area of a cable (electric wire) before crimping the metallic cylindrical part 11*b* is A, a cross-sectional area of the cable (electric wire) after crimping the metallic cylindrical part 11*b* is B, and B/A is provided as the crimping ratio K.

(Cable 50)

Figure 4A:
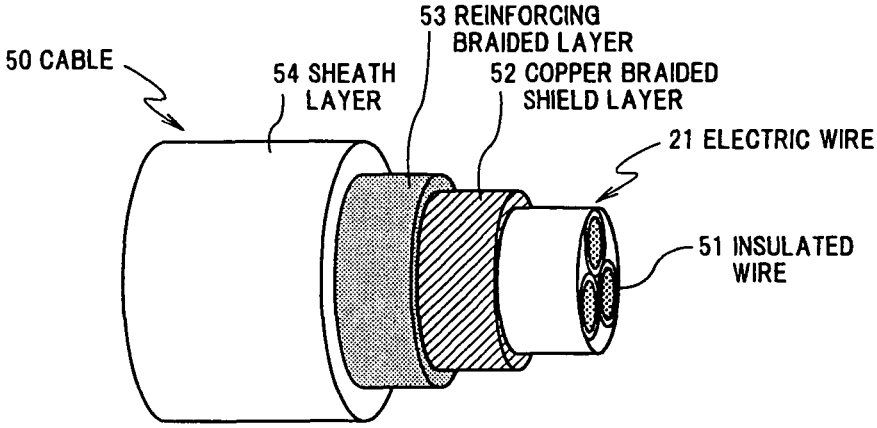
Figure 4B:
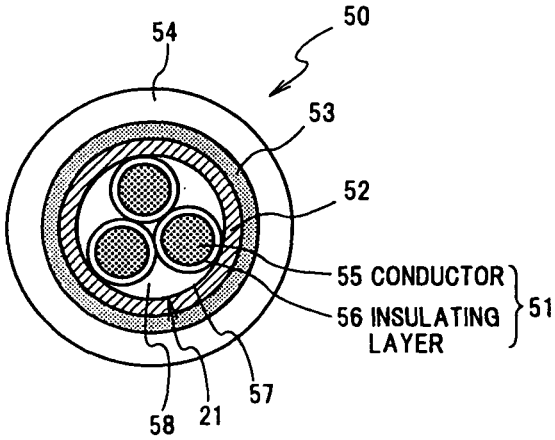

FIGS. 4A and 4B are diagrams showing a structure of a cable 50 used in the evaluation test, wherein FIG. 4A is a perspective view showing the cable 50, and FIG. 4B is a cross sectional view of the cable 50.

Referring to FIGS. 4A and 4B, the cable 50 has three insulated wires 51, each of which comprises a conductor 55 and an insulating layer 56 coating around the conductor 55, a copper braided shield layer 52 made of braided copper wires and provided at an outer periphery of the three insulated wires 51, a reinforcing braided layer 53 made of braided fiber materials and provided at an outer periphery of the copper braided shield layer 52, and a sheath layer 54 provided at an outer periphery of the reinforcing braided layer 53.

The conductor 55 of the insulated wire 51 comprises 602 pieces of Sn-plated copper alloy wire with a diameter of 0.08 mm (ϕ0.08) that are stranded with each other, and the insulating layer 56 provided at the outer periphery of the conductor 55 is made of fluororesin (e.g. tetrafluoroethylene, ethylene copolymer), and has a thickness of 0.5 mm. The three insulated wires 51 are twisted and bundled to provide the electric wire 21. An outer periphery of the electric wire 21 comprising bundled three insulated wires 51 is wrapped by a paper binder tape 57, and a filler 58 made of fiber materials is interposed between the insulated wires (electric power lines) 51 and the paper binder tape 57, so as to provide the electric wire 21 with a circular cross section. The copper braided shield layer 52 comprises a braided copper wires, each has a diameter of 0.12 mm (ϕ0.12). The fiber materials composing the reinforcing braided layer 53 is polyvinyl alcohol with a diameter of 0.1 mm (ϕ0.1). Material of the sheath layer 54 is ethylene propylene diene rubber with a thickness of 1 mm.

(Measurement of the Cable Holding Force)

Figure 5:
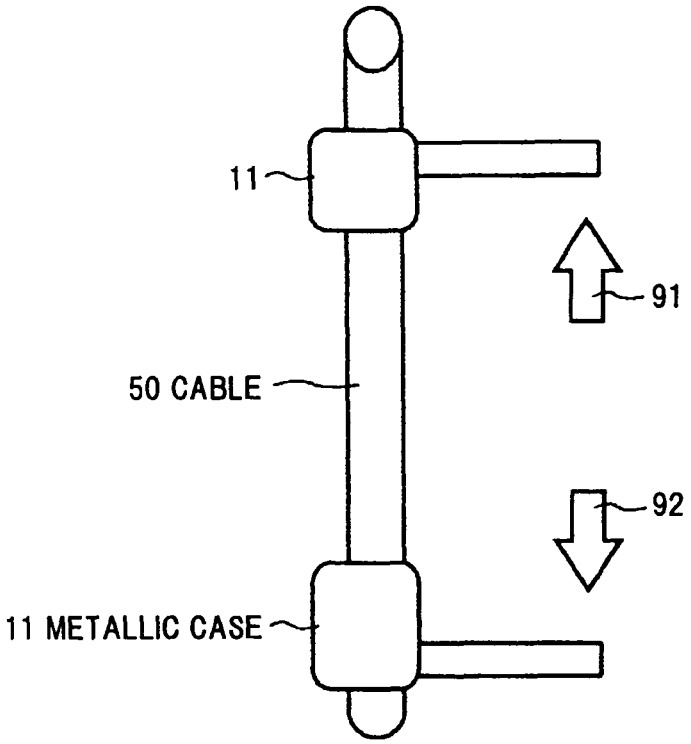
FIG. 5 is an explanatory diagram showing a method for carrying out a tensile test of the connector.

The cable holding force was measured according to following method. FIG. 5 is an explanatory diagram showing a method for carrying out a tensile test of the connector 11.

Firstly, the connectors 10, each of which is provided with the metallic case 11 as shown in FIGS. 1 to 3, were attached to both ends of the cable 50.

Referring to FIG. 5, the metallic cases 11 were attached to both ends of the cable 50. A tensile load was applied to the metallic cases 11 in opposite directions indicated by arrows 91, 92 at a tensile speed for testing of 10 to 30 mm/min. The holding force when a fixed position of the metallic case 11 is shifted by 1 mm from an initial mounting position of the metallic case 11. In this measurement, the tensile load was set to be 1000N at maximum. In the case that the fixed position of the metallic case 11 was not shifted, the holding force was evaluated as 1000N or more.

TABLE 1 shows a result of the cable holding force measuring test.

When the crimping ratio K was within a range of $0.60 \leq K \leq 0.95$, a cable holding force of the connector 10 was 1000N or more. When the crimping ratio K was less than 0.6, a crimped region of the metallic cylindrical part 11*b* of the metallic case 11 bites into the sheath layer 54, and finally until the insulating layer 56 of the electric wire 21, so that the sheath layer 54 and/or the insulating layer 56 may be broken.

TABLE 1

| Crimping ratio K | 0.97 | 0.96 | 0.95 | 0.90 | 0.80 | 0.70 | 0.60 | 0.55 |
|---|---|---|---|---|---|---|---|---|
| Cable holding force | 600 N | 800 N | 1000 N or more | 1000 N or more | 1000 N or more | 1000 N or more | 1000 N or more | Sheath was broken |

(Effects of the First Embodiment)

Accordingly, it is possible to realize a cable fixing method and a cable connecting part with high reliability and high holding force of the cable 50, by crimping the metallic cylindrical part 11*b* in such a manner that the crimping ratio K is within a range of $0.60 \leq K \leq 0.95$.

Further, the cable holding force against the tensile force may be further improved by providing the cable (electric wire) 50 to be crimped with the reinforcing braided layer 53.

The fiber material composing the reinforcing braided layer 53 is preferably polymer to metal, since the holding force of a polymer fiber against the tensile force is greater than that of a metal fiber.

The fiber material composing the reinforcing braided layer 53 may be polyethylene terephthalate, or polyethylene-2.6-naphthalate.

(Variation)

In the first embodiment, the connector 10 is threadably mounted on the exterior equipment by the bolt 31. However, the present invention is not limited thereto. For example, when the terminal holder accommodating part 11*a* of the metallic case 11 has a cylindrical shape, a threaded ring may be provided at the outer periphery of the metallic case 11, and a case of the exterior equipment may be threaded to correspond to threads of the ring, so that the metallic case 11 may be fixed to the exterior equipment by screwing the ring into the threaded part of the exterior equipment.

Second Embodiment

Figure 6:
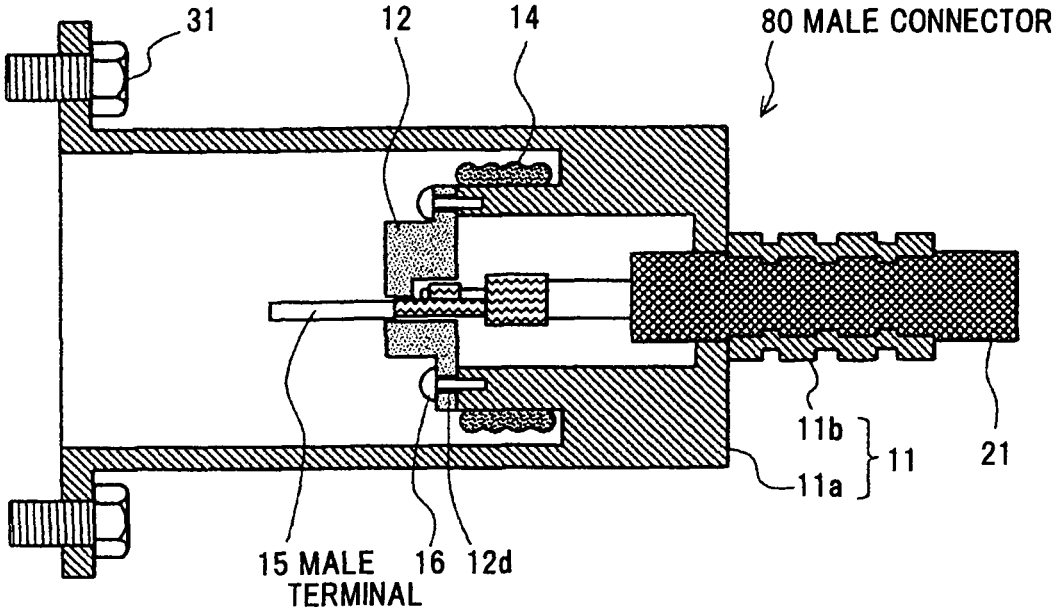
FIG. 6 is a cross sectional view of a male connector in the second embodiment according to the present invention.

FIG. 6 is a cross sectional view of a male connector 80 in the second embodiment according to the present invention.

In the first embodiment, the female connector 10 is used. However, configuration of the metallic case, the terminal holder and the terminal may be appropriately changed. For example, as shown in FIG. 6, the male connector 80 may be provided in place of the female connector 10, by replacing the female terminal 13 with a male terminal 15.

(Examples of the Cable)

FIGS. 7A to 7D are diagrams showing examples of the electric wire (cable) to be used in the present invention.

Figure 7A:
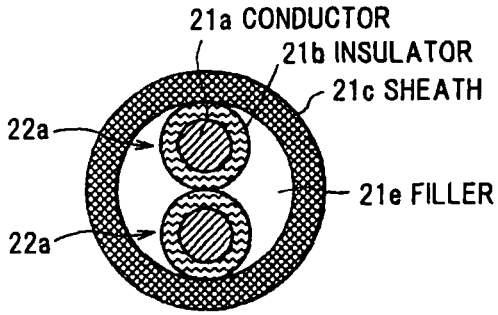
Figure 7B:
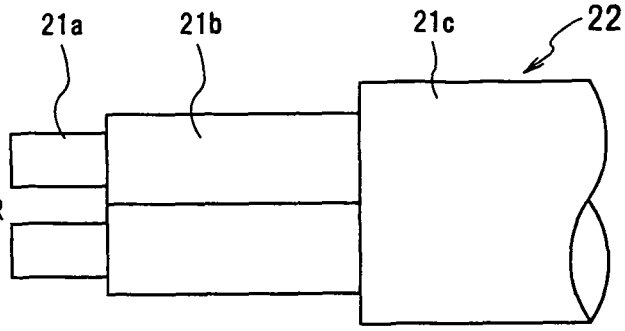

FIGS. 7A and 7B shows an electric wire 22 having two power lines or two signal lines. The two power lines (or the two signal lines) 22*a*, 22*a*, each of which comprises a conductor 21*a* and an insulator 21*b* provided at an outer periphery of the conductor 21*a*, are twisted and a sheath 21*c* is provided at an outer periphery of the twisted insulated wires via a filler 21*e*.

Figure 7C:
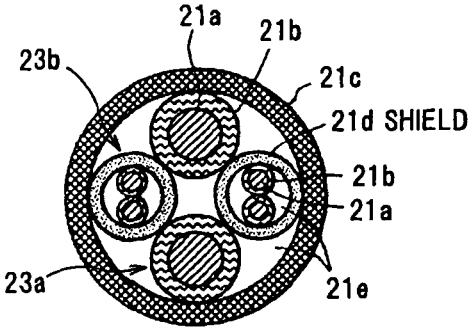
Figure 7D:
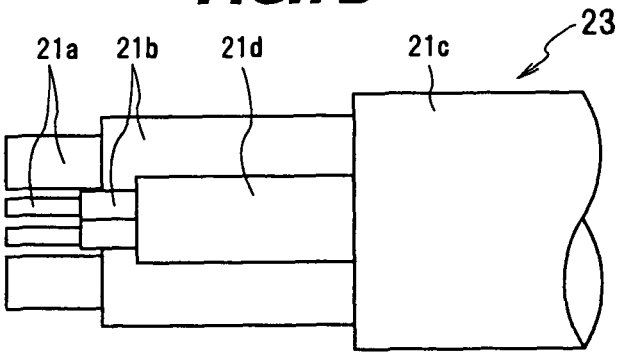

FIGS. 7C and 7D shows a complex type cable 23 comprising two power lines 23*a*, 23*a*, two twin-wire signal lines 23*b*, 23*b*, a filler 21*e* interposed between the power lines 23*a* and the twin-wire signal lines 23*b*, and a sheath 21*c* provided at an outer periphery of the power lines 23*a* and the twin-wire signal lines 23*b*. Each of the power lines 23*a* comprises a conductor 21*a* and an insulator 21*b* provided at an outer periphery of the conductor 21*a*. Each of the twin-wire signal lines 23*b* comprises two signal lines, each of which comprises a conductor 21*a* and an insulator 21*b* provided at an outer periphery of the conductor 21*a*, a shield 21*d* provided at an outer periphery of the two signal lines and a filler 21*e* interposed between the shield 21*d* and the two signal lines.

Figure 7E:
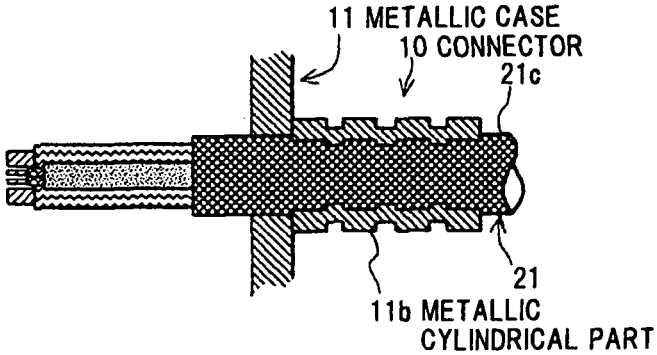
FIG. 7E shows a state where the complex type cable is used in the connector shown in FIG. 1.

FIG. 7E shows a state where the complex type cable 23 is used in the connector 10 shown in FIG. 1. The complex type cable 23 is fixed to the metallic case 11 by crimping the metallic cylindrical part 11*b* which accommodates the sheath 21*c*. The conductors 21*a* of each of the power line 23*a* and the twin-wire signal line 23*b* is provided with a terminal, and the terminal is fixed to a terminal holder accommodating part of the metallic case 11 via a terminal holder (not shown). The electric wires and cables used for the connector 10 are not limited to the above examples. The connector 10 may be applied to electric wires and cable with other configurations.

(Application Example of the Connector 10)

Figure 8:
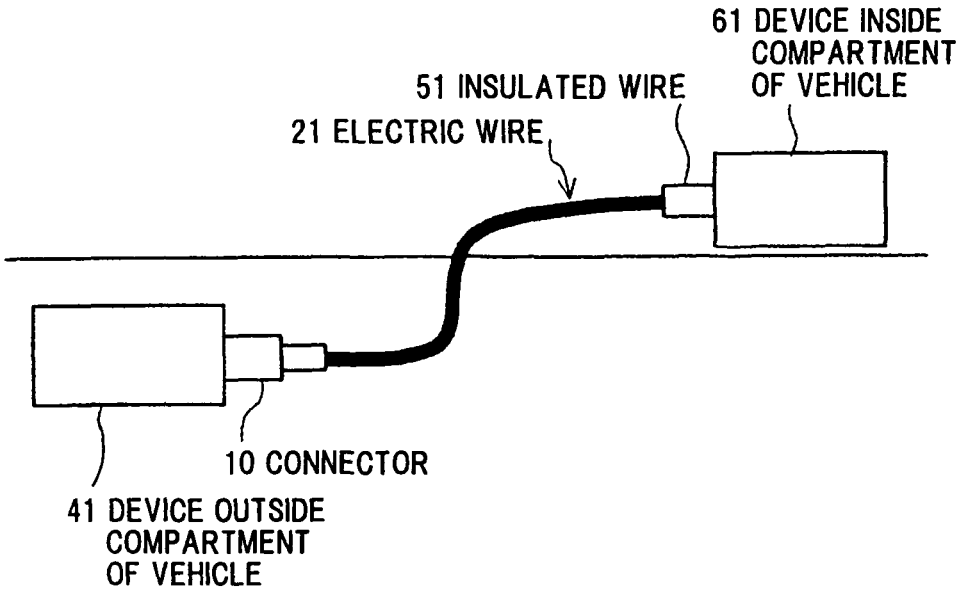
FIG. 8 is an explanatory diagram showing an application example of the connector of the present invention.

FIG. 8 is an explanatory diagram showing an application example of the connector 10 of the present invention.

In the application example of FIG. 8, a control signal or an electric power is supplied from a device (e.g. a control unit or a power source) 61 located inside a compartment of a vehicle to a device 41 located outside the compartment of the vehicle through the electric wire 21. The electric wire 21 is connected to the device 41 outside the compartment of the vehicle via the connector 10. According to this structure, it is possible to realize the connection with excellent water proofing property, holding force of the electric wire against the tensile force, and mechanical strength.

Figure 9:
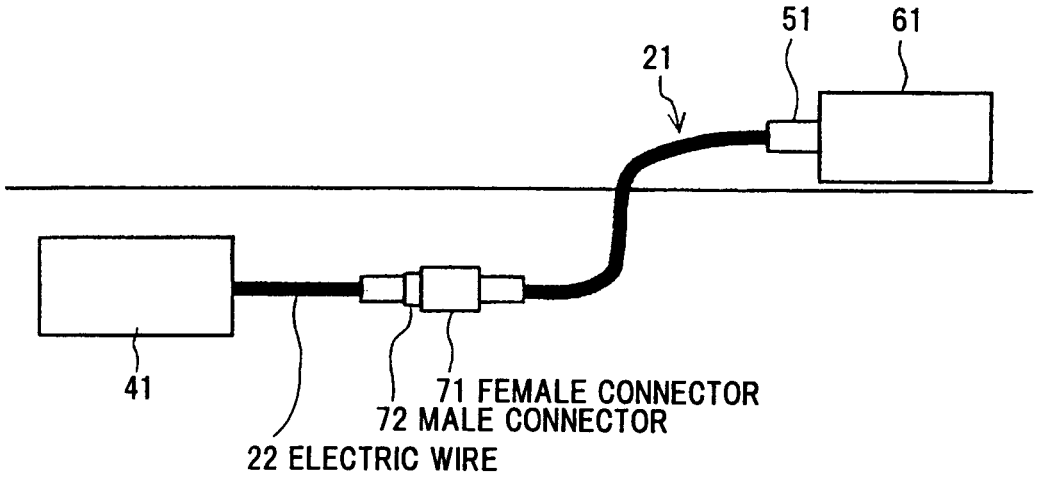
FIG. 9 is an explanatory diagram showing another application example of the connector of the present invention.

FIG. 9 is an explanatory diagram showing another application example of the connector 10 of the present invention.

In the application example of FIG. 9, an electric wire 22 extended from a device 41 located outside a compartment of a vehicle is provided with a male connector 72, and an electric wire 21 extended from a device 61 located inside the compartment of the vehicle is provided with a female connector 71. The device 41 and the device 61 are electrically connected to each other by connecting the female connector 71 to the male connector 72. Herein, the male connector 72 is different from the male connector 80, in that the configuration of the metallic case is changed to be insertable into the female connector 71. A connecting part between the female connector 71 and the male connector 72 may be totally or partially accommodated in the metallic case. Further, the connecting part may be fixed to a car body of the vehicle such as automobile by a bracket or the like. Similarly to the application example shown in FIG. 8, according to this structure, it is possible to realize the connection with excellent water proofing property, holding force of the electric wire against the tensile force, and mechanical strength.

The present invention may be applied to connection of the cable to the electronic devices to be used at a location under an on-vehicle spring, or connection of the cable used for a movable part such as robot to the electronic devices.

Third Embodiment

Next, a fixing structure 100 in the third embodiment will be explained below.

Figure 10:
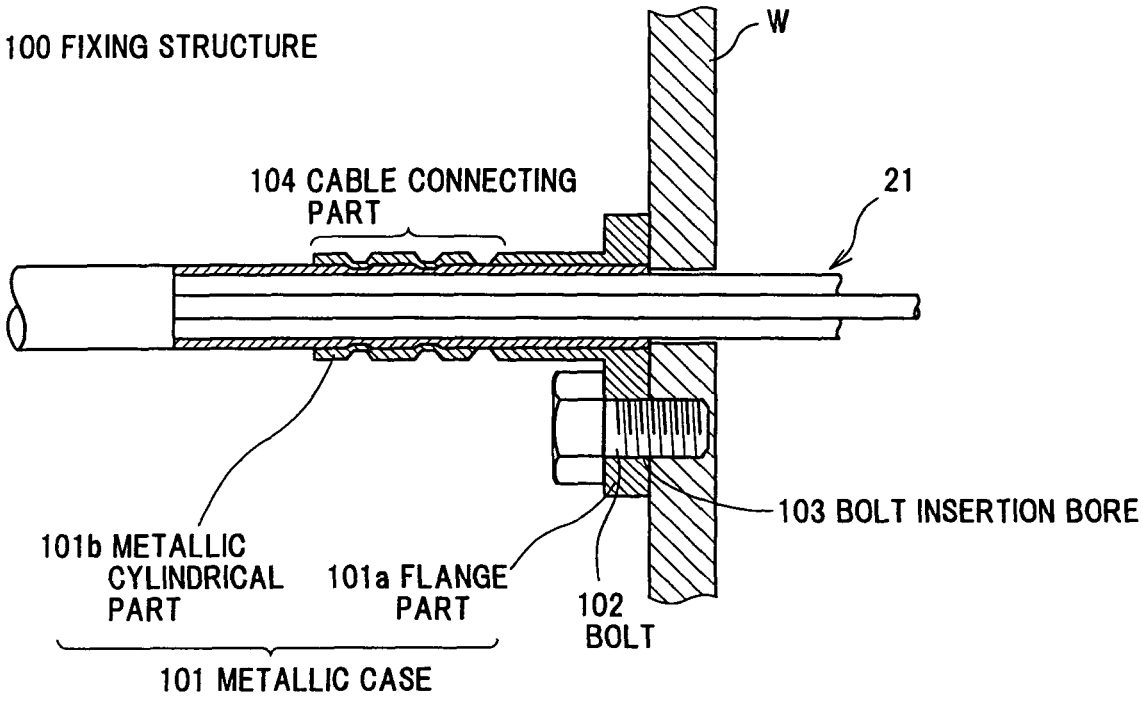
FIG. 10 is a longitudinal cross sectional view of a fixing structure in the third embodiment according to the present invention.

FIG. 10 is a longitudinal cross sectional view of the fixing structure 100 in the third embodiment according to the present invention.

Figure 11A:
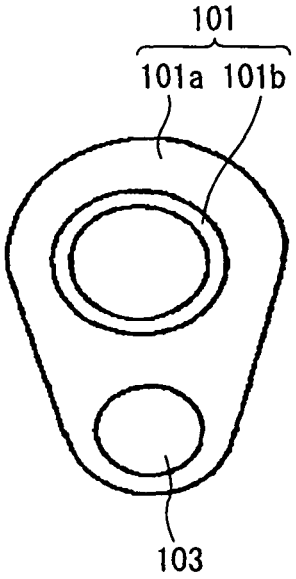
Figure 11B:
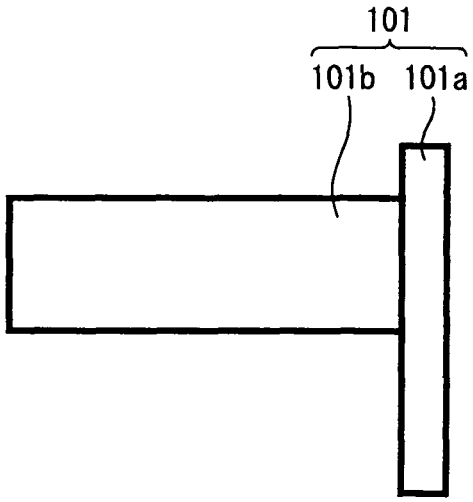

FIGS. 11A and 11B are diagrams showing a metallic case 101 used for the fixing structure 100 in the third embodiment according to the present invention, wherein FIG. 11A is a front view thereof, and FIG. 11B is a side view thereof.

Referring to FIG. 10, the fixing structure 100 in the third embodiment according to the invention comprises a metallic case 101 comprising a metallic cylindrical part 101*b*, which accommodates a part of a cable 21 in a longitudinal direction, in which the cable 21 is fixed to the metallic case 101 by crimping a cable connecting part 104 of the metallic cylindrical part 101*b*. More particularly, in the fixing structure 100, the metallic case 101 is connected to the cable 21 by crimping the metallic cylindrical part 101*b* in such a manner that $0.60 \leq K \leq 0.95$ is established, wherein a cross-sectional area of the cable 21 before crimping the metallic cylindrical part 101*b* is A, a cross-sectional area of the cable 21 after crimping the metallic cylindrical part 101*b* is B, and B/A is a crimping ratio K. In other words, the fixing structure 100 comprises the cable connecting part 104 for fixing the cable 21 to the metallic case 101*b*, in which the metallic cylindrical part 101*b* is crimped in such a manner that the crimping ratio K is within a range of $0.60 \leq K \leq 0.95$. Further, the fixing structure 100 uses the cable fixing method of fixing the cable 21 to the metallic case 101, by crimping the metallic cylindrical part 101*b* in such a manner that the crimping ratio K is within a range of $0.60 \leq K \leq 0.95$.

Referring to FIGS. 11A and 11B, the metallic case 101 comprises at least the metallic cylindrical part 101*b*. A part of the cable 21 in the longitudinal direction is accommodated in the metallic cylindrical part 101*b*. The metallic case 101 and the cable 21 are connected to each other by crimping the metallic cylindrical part 101*b* accommodating the part of the cable 21 in the longitudinal direction at the cable connection part 104, with using the cable fixing method in which $0.60 \leq K \leq 0.95$ is established, when the cross-sectional area of the cable 21 before crimping the metallic cylindrical part 101*b* is A, the cross-sectional area of the cable 21 after crimping the metallic cylindrical part 101*b* is B, and B/A is the crimping ratio K.

As described above, the metallic case 101 and the cable 21 can be fixed to have high holding force by crimping the metallic cylindrical part 101*b* to provide the crimping ratio K within a range of $0.60 \leq K \leq 0.95$, and it is possible to realize the cable fixing method and the cable connecting part 104 with high reliability without breaking the cable sheath layer or the insulating layer due to excessive crimping.

Such a contemplation is based on the test carried out on the connector 10 in the first embodiment as to the relationship between the crimping ratio and the cable holding force.

In the third embodiment, it is preferable that the cable 21, which is connected to the metallic case 101 by the cable connecting part 104 with using the cable fixing method as described above, comprises a core comprising a single core or a stranded core comprising stranded wire conductors, an insulative coating layer provided at an outer periphery of the single core (or the stranded core), a sheath layer as an outermost layer, and a reinforcing braided layer provided between the insulative coating layer and the sheath layer, the reinforcing braided layer comprising a plurality of fiber materials comprising polymer such as polyethylene terephthalate or polyethylene-2.6-naphtalate. By using the cable having such a configuration, it is possible to enhance biting of the metallic cylindrical part 101*b* into the cable 21 when the metallic cylindrical part 101*b* is crimped, thereby realizing higher holding force. As an example of the cable 21, the complex type cable 23 having the power lines 23*a* and the signal lines 23*b* shown in FIGS. 7C and 7D may be used.

In the third embodiment, as shown in FIGS. 11A and 11B, the metallic case 101 further comprises a flange part 101*a* provided at one end of the metallic cylindrical part 101*b*, which is provided integrally with the metallic cylindrical part 101*b*. The flange part 101*a* may be provided at a part of a side surface of the metallic cylindrical part 101*b* in place of being provided at the one end of the metallic cylindrical part 101*b*.

The flange part 101*a* is provided with a bolt insertion bore 103 through which a shaft of a bolt 102 is inserted. An outer periphery of the bolt insertion bore 103 is smaller than an outer periphery of a head portion of the bolt 102.

Referring to FIG. 10, in the fixing structure 100, the shaft of the bolt 102 is inserted through the bolt insertion bore 103 provided at the flange part 101*a*, and the shaft of the bolt 102 is threadably fitted into a bolt hole (not shown) arbitrary provided at a fixing object (e.g. a car body case W), thereby fixing the metallic case 101 to the car body case W.

As described above, the fixing structure 100 may contribute to lightweighting, since the number of parts is small and the structure is simple.

(Water Proofing Property and the Cable Holding Force Against the Tensile Force Under High Temperature or Low Temperature for a Long Time Period)

In general, the connectors used for the vehicle such as automobile may be exposed to high temperature (e.g. 120° C.) or low temperature (e.g. −40° C.) for a long time period (e.g. several dozens hours). However, even when the connector is used in such an environment, it is necessary to keep the "water proofing property and holding force of the electric wire against the tensile force".

Therefore, so as to solve the above problem, following evaluation was carried out.

As shown in TABLE 1, when the crimping ratio K is within the range of $0.60 \leq K \leq 0.95$, the connector 10 has the cable holding force (i.e. a holding force of the electric wire against the tensile force) of 1000N or more. Samples for the critical values (upper and lower limits) of the above range, namely, K=0.60 (the lower limit) and K=0.95 (the upper limit), were prepared. Then, test for evaluating long time heat resistance for resisting a high temperature for a long time period, and long time cold resistance for resisting a low temperature for a long time period were carried out.

Figure 12:
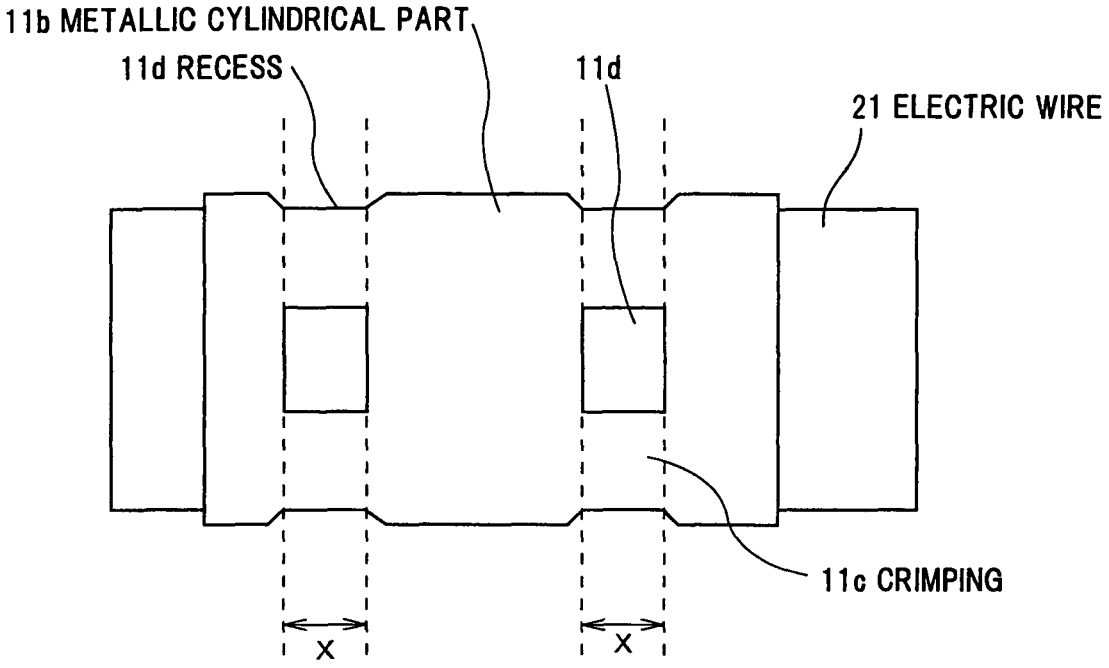
FIG. 12 is an explanatory view for explaining a crimped region and a recess.

FIG. 12 is an explanatory view for explaining a crimped region 11*c* and a recess 11*d* of the metallic cylindrical part lib.

Herein, the samples were fabricated by varying a total area C of a plurality of recesses 11*d* with respect to a surface area D of a crimping region 11*c*. This is based on the Inventor's contemplation that excellent long time heat resistance and long time cold resistance may be influenced by relationship between the surface area D of a crimping region 11*c* before crimping the metallic cylindrical part 11*b* and the total area C of the plurality of recesses lid formed after crimping, in the crimping region 11*c* which is a part of the metallic cylindrical part 11*b*.

More concretely, the crimping area 11*c* is one part of the metallic cylindrical part lib, and a region indicated by X on a surface of the metallic cylindrical part lib in FIG. 12. The region indicated by X is a region between both sides of a bottom surface of the recess lid. An area of the recess 11*d* is an area of the bottom surface. Therefore, the total area C of the recesses 11*d* is a total of areas of bottom surfaces of the recesses 11*d*.

(Evaluation of the Long Time Heat Resistance)

The samples were prepared by varying the relationship between the surface area D of the crimping region 11*c* and the total area D of the recesses 11*d* formed after crimping. Then, the prepared samples were exposed in the 120° C. environment for long time. Thereafter, the evaluation tests for the water proofing property and the holding force (holding force of the electric wire against the tensile force) were carried out.

A test for evaluating the water proofing property is carried out by injecting compressed air (atmospheric pressure of 100 kpa) into the terminal holder accommodating part 11*a* in the sample for analysis, and examining presence of air leakage when the sample was emerged in the water. If the air leakage is observed, the sample is evaluated as not good (i.e. failed the water proofing property test).

A test for evaluating the holding force was carried out by measuring magnitude of the tensile force when the electric wire 21 was pulled. If the tensile force is 1000N or less, the sample is evaluated as not good (i.e. failed the holding force test).

TABLE 2 shows evaluation results. It is confirmed that the sample, in which C≥D/5 is established, have excellent water proofing property and holding force even after exposition in the environment at a temperature of 120° C. for 200 hours.

TABLE 2

| Temperature environment | C = D/7 | C = D/6 | C = D/5 | C = D/4 | C-D/3 |
|---|---|---|---|---|---|
| Initial state | ○ | ○ | ○ | ○ | ○ |
| 120° C. 30 hours | ○ | ○ | ○ | ○ | ○ |
| 120° C. 50 hours | X | ○ | ○ | ○ | ○ |
| 120° C. 100 hours | X | ○ | ○ | ○ | ○ |
| 120° C. 200 hours | X | X | ○ | ○ | ○ |

(○: passed the water proofing property test and the holding force test)
(X: failed the water proofing property test or the holding force test)

(Evaluation of the Long Time Cold Resistance)

Similarly to the evaluation of the long time heat resistance, the samples were prepared by varying the relationship between the surface area D of the crimping region 11*c* and the total area D of the recesses 11*d* formed after crimping. Then, the prepared samples were exposed in the −40° C. environment for long time. Thereafter, the evaluation tests for the water proofing property and the holding force (holding force of the electric wire against the tensile force) were carried out.

The test for evaluating the water proofing property and the test for evaluating the holding force were similar to those in evaluation of the long time heat resistance.

TABLE 3

| Temperature environment | C = D/7 | C = D/6 | C = D/5 | C = D/4 | C-D/3 |
|---|---|---|---|---|---|
| Initial state | ○ | ○ | ○ | ○ | ○ |
| −40° C. 30 hours | ○ | ○ | ○ | ○ | ○ |
| −40° C. 50 hours | ○ | ○ | ○ | ○ | ○ |
| −40° C. 100 hours | X | ○ | ○ | ○ | ○ |
| −40° C. 200 hours | X | X | ○ | ○ | ○ |

(○: passed the water proofing property test and the holding force test)
(X: failed the water proofing property test or the holding force test)

Although the invention has been described, the invention according to claims is not to be limited by the above-mentioned embodiments and examples. Further, please note that not all combinations of the features described in the embodiments and the examples are not necessary to solve the problem of the invention.

What is claimed is:

1. A cable fixing method for a cable for a vehicle, said method comprising:

inserting a part of a cable in a longitudinal direction into a metallic cylindrical part of a metallic case, the cable comprising a core, an insulative coating layer provided at an outer periphery of the core, a sheath layer provided as an outermost layer, and a reinforcing braided layer provided between the insulative coating layer and the sheath layer, the reinforcing braided layer comprising braided fiber materials consisting of a polymer; and fixing the cable to the metallic case by crimping the metallic cylindrical part which accommodates the part of the cable in the longitudinal direction in such a manner that 0.60≤K≤0.95 is established, wherein a cross-sectional area of the cable before crimping the metallic cylindrical part is A, a cross-sectional area of the cable after crimping the metallic cylindrical part is B, and B/A is a crimping ratio K, and wherein the metallic cylindrical part is crimped to form a plurality of recesses at an outer periphery of a crimping region which is a part of the metallic cylindrical part, and C≥D/5 is established wherein C is a total area of the plurality of recesses formed after crimping the metallic cylindrical part and D is a surface area of the crimping region before crimping the metallic cylindrical part.

2. The method according to claim 1, wherein the core comprises a single wire or a stranded wire comprising a plurality of wire conductors.

3. The method according to claim 1, wherein an end portion of the cable, along the longitudinal direction, is located inside the metallic case.

4. The method according to claim 1, further comprising:

a terminal press-fitted to a core of the cable, wherein, in the longitudinal direction, an edge of the cable is located between the terminal and an edge of the metallic case.

5. The method according to claim 1, wherein the metallic case further comprises a terminal holder accommodating part that comprises a locking lance protruded upward from the terminal holder accommodating part to hold a terminal, which is connected to the core of the cable, inside the metallic case, said locking lance engaging with a notch provided in the terminal.

6. The method according to claim 1, wherein the metallic case further comprises a terminal holder accommodating part, a terminal press-fitted to the core of the cable is fixed to a terminal holder comprising an insulative material, and the terminal holder is accommodated in and fixed to the terminal holder accommodating part to provide a connector.

7. The method according to claim 6, wherein the core comprises a single wire or a stranded wire comprising a plurality of wire conductors.

8. The method according to claim 6, wherein the connector comprises a resin cover or a rubber cover at an outer surface of the metallic case.

9. The method according to claim 1, further comprising:

a terminal connected to a core of the cable, said terminal being located, in the longitudinal direction, between edges of the metallic case such that edges of the terminal, in the longitudinal direction, are located inside the metallic case.

10. The method according to claim 9, wherein the metallic case further comprises a terminal holder accommodating part that comprises a locking lance protruded upward from the terminal holder accommodating part to hold the terminal inside the metallic case, said locking lance engaging with a notch provided in the terminal.

11. A cable connecting part for a cable for a vehicle, said cable connecting part comprising:

a metallic case comprising a metallic cylindrical part which accommodates a part of a cable in a longitudinal direction, the cable comprising a core, an insulative coating layer provided at an outer periphery of the core, a sheath layer provided as an outermost layer, and a reinforcing braided layer provided between the insulative coating layer and the sheath layer, the reinforcing braided layer comprising braided fiber materials consisting of a polymer, wherein the metallic cylindrical part accommodating the part of the cable in the longitudinal direction is crimped to fix the cable to the metallic case, in such a manner that $0.60 \leq K \leq 0.95$ is established, wherein a cross-sectional area of the cable before crimping the metallic cylindrical part is A, a cross-sectional area of the cable after crimping the metallic cylindrical part is B, and B/A is a crimping ratio K, and wherein the metallic cylindrical part is crimped to form a plurality of recesses at an outer periphery of a crimping region which is a part of the metallic cylindrical part, and $C \geq D/5$ is established wherein C is a total area of the plurality of recesses formed after crimping the metallic cylindrical part and D is a surface area of the crimping region before crimping the metallic cylindrical part.

12. The cable connecting part according to claim 11, wherein the core comprises a single wire or a stranded wire comprising a plurality of wire conductors.

13. The cable connecting part according to claim 11, wherein an end portion of the cable, along the longitudinal direction, is located inside the metallic case.

14. The cable connecting part according to claim 11, further comprising:

a terminal press-fitted to the core of the cable, wherein, in the longitudinal direction, an edge of the cable is located between the terminal and an edge of the metallic case.

15. The cable connecting part according to claim 11, wherein the metallic case further comprises a terminal holder accommodating part that comprises a locking lance protruded upward from the terminal holder accommodating part to hold a terminal, which is connected to the core of the cable, inside the metallic case, said locking lance engaging with a notch provided in the terminal.

16. The cable connecting part according to claim 11, wherein the metallic case further comprises a terminal holder accommodating part, a terminal press-fitted to the core of the cable is fixed to a terminal holder comprising an insulative material, and the terminal holder is accommodated in and fixed to the terminal holder accommodating part to provide a connector.

17. The cable connecting part according to claim 16, wherein the core comprises a single wire or a stranded wire comprising a plurality of wire conductors.

18. The cable connecting part according to claim 16, further comprising a resin cover or rubber cover at an outer surface of the metallic case.

19. The cable connecting part according to claim 11, further comprising:

a terminal connected to the core of the cable, said terminal being located, in the longitudinal direction, between edges of the metallic case such that edges of the terminal, in the longitudinal direction, are located inside the metallic case.

20. The cable connecting part according to claim 19, wherein the metallic case further comprises a terminal holder accommodating part that comprises a locking lance protruded upward from the terminal holder accommodating part to hold the terminal inside the metallic case, said locking lance engaging with a notch provided in the terminal.

* * * * *